United States Patent [19]

Kashiwagi et al.

[11] Patent Number: 4,481,390

[45] Date of Patent: Nov. 6, 1984

[54] VACUUM CIRCUIT INTERRUPTER

[75] Inventors: Yoshiyuki Kashiwagi; Yutaka Kashimoto, both of Tokyo; Shinzo Sakuma, Kawasaki; Junichi Warabi, Shizuoka; Yukio Kobari; Hidemi Kawaguchi, both of Tokyo, all of Japan

[73] Assignee: Kabushiki Kaisha Meidensha, Tokyo, Japan

[21] Appl. No.: 279,302

[22] Filed: Jun. 30, 1981

[30] Foreign Application Priority Data

Jul. 1, 1980 [JP] Japan ..... 55-90367

[51] Int. Cl.[3] ..... H01H 33/00

[52] U.S. Cl. ..... 200/144 B; 200/267

[58] Field of Search ..... 200/144 B, 267, 268; 65/69.1

[56] References Cited

U.S. PATENT DOCUMENTS

| | | | |
|---|---|---|---|
| 2,794,087 | 5/1957 | Jennings et al. | 200/144 B |
| 3,430,015 | 2/1969 | Crouch et al. | 200/144 B |
| 3,495,142 | 2/1970 | Herrgen et al. | 361/279 |
| 3,576,960 | 5/1971 | Kurtz | 200/144 B |
| 3,674,958 | 7/1972 | Attia et al. | 200/144 B |
| 3,727,018 | 4/1973 | Wesoloski et al. | 200/144 B |
| 3,812,314 | 5/1974 | Nonken | 200/144 B |
| 4,077,114 | 3/1978 | Sakuma | 200/144 B X |

FOREIGN PATENT DOCUMENTS

| | | |
|---|---|---|
| 1298448 | 2/1970 | United Kingdom . |
| 2010587 | 12/1978 | United Kingdom . |

*Primary Examiner*—E. A. Goldberg
*Assistant Examiner*—Morris Ginsburg
*Attorney, Agent, or Firm*—Lowe, King, Price & Becker

[57] ABSTRACT

A vacuum circuit interrupter includes a cylinder made of a metal relatively easy to deform plastically, and first and second insulating disks closing the ends of the metallic cylinder to form therewith an evacuated envelope. A stationary rod enters the envelope through the first disk in such a manner as to provide a seal therewith. A movable conductive rod movably enters the envelope through the second disk. A bellows is fixed at its one end to the movable rod and at its other end to the second disk in such a manner as to provide a seal about the movable rod to allow for movement thereof without impairing the vacuum inside the envelope. Stationary and movable electrodes are connected to the stationary and movable rods respectively in such a manner as to engage and disengage with each other according to the movement of the movable rod.

16 Claims, 14 Drawing Figures

VACUUM CIRCUIT INTERRUPTER

BACKGROUND OF THE INVENTION

1. Field of the Invention

This invention relates to a circuit interrupter and more particularly to an interrupter of the vacuum type which includes an evacuated envelope, in which a movable and a stationary contact rod are arranged to open and close a circuit.

2. Description of the Prior Art

In a vacuum circuit interrupter of the prior art, a pair of contacts able to engage each other are housed in an evacuated envelope composed of an appropriate combination of insulating and metallic members, the former being made of glass or ceramics and the latter being made of an iron-nickel or iron-nickel-cobalt alloy having a coefficient of thermal expansion which closely matches that of the glass or ceramics. However, iron-nickel or iron-nickel-cobalt alloys are relatively expensive.

SUMMARY OF THE INVENTION

It is an object of the present invention to provide a vacuum circuit interrupter which has a relatively high reliability.

It is another object of the present invention to provide a vacuum circuit interrupter which has a relatively high durability.

It is a further object of the present invention to provide a vacuum circuit interrupter which is relatively inexpensive.

The vacuum circuit interrupter of the present invention includes a cylinder made of metal that is relatively easy to deform plastically, and first and second insulating disks closing opposite ends of the metallic cylinder to form therewith an evacuated envelope. The first and second disks each have a central aperture. A stationary conductive rod coaxially enters the envelope through the central aperture of the first disk, and is fixed to the first disk in such a manner as to provide a seal therewith. A movable conductive rod coaxially and movably enters the envelope through the central aperture of the second disk without impairing the vacuum inside the envelope. Stationary and movable electrodes are connected to the stationary and movable rods respectively in such a manner as to engage each other when the movable rod moves toward the stationary rod and disengage when the movable rod moves away from the stationary rod.

The above and other objects, features and advantages of the present invention will be apparent from the following description of preferred embodiments thereof, taken in conjunction with the drawings.

DESCRIPTION OF THE PREFERRED EMBODIMENTS

Figure 1:
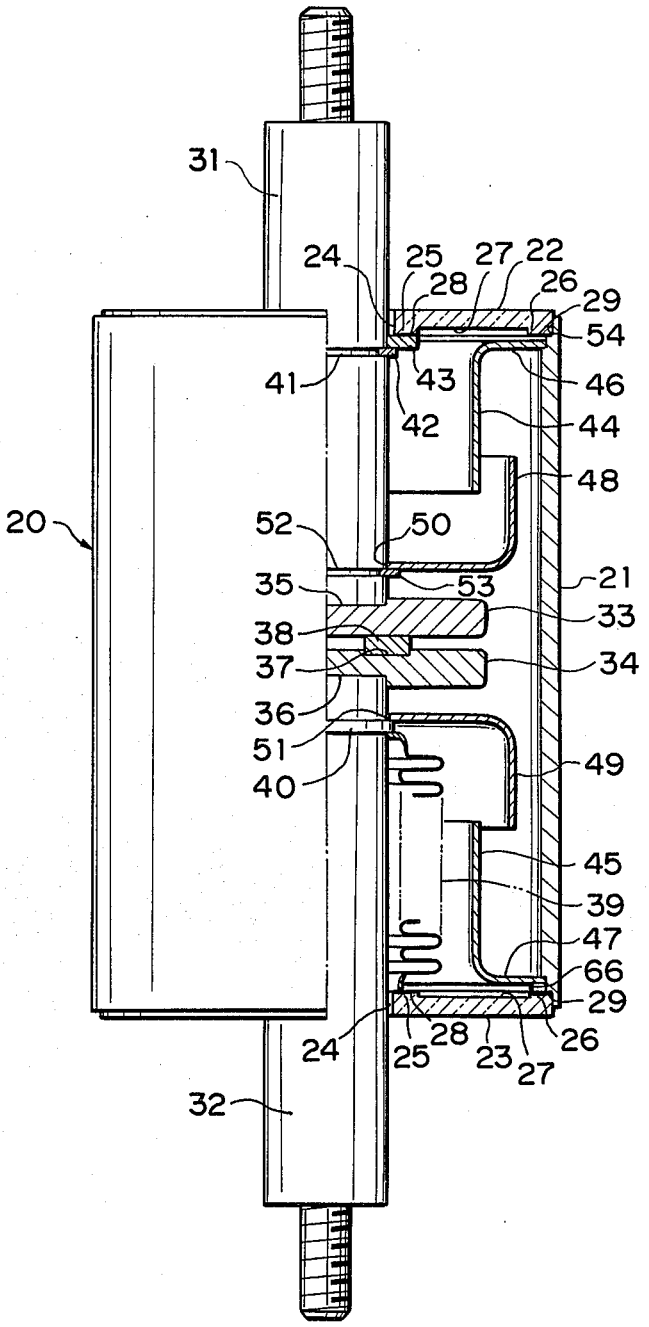
FIG. 1 is a longitudinal partly sectional view of a vacuum circuit interrupter according to a first embodiment of the present invention.

Referring to FIG. 1, there is shown a vacuum circuit interrupter of a first embodiment of the present invention which is in its closed state and has an evacuated housing or envelope 20. The envelope 20 includes of a metallic cylinder 21 and a pair of insulating disks 22 and 23 closing the opposite ends of the cylinder 21.

Each of the disks 22 and 23 has a circular central aperture 24 therein and concentrically arranged annular projections 25 and 26 on the inner surface thereof. In other words, each of the disks 22 and 23 has an annular groove 27 so as to form the projections 25 and 26 on the inner and outer peripheries thereof respectively. Each of the projections 25 and 26 has a previously ground surfaces covered with metalized layers 28 and 29 respectively. The grooves 27 facilitate grinding of the projections 25 and 26 and are approximately 0.1 to 0.5 mm in depth. The metallic cylinder 21 is brazed at opposite ends thereof to the outer metalized layers 29 on the insulating disks 22 and 23 to fix the disks 22 and 23 thereto.

The cylinder 21 is made of a plastically deformable metal, such as copper or iron, which is relatively inexpensive and is relatively easy to deform plastically during the cooling process after brazing to alleviate thermal stresses generated by the cooling process after brazing. A non-magnetic metal such as copper is more preferable to a magnetic metal such as iron for the cylinder 21, because vibration forces exerted thereon by an alternating current passing through the interrupter are weaker than that on a magnetic metal and consequently the interrupter has a relatively high durability and reliability. The disks 22 and 23 are made of an inorganic insulator, such as alumina ceramics or crystallized glass. The metalized layers 28 and 29 are of a manganese-titanium or molybdenum-manganese-titanium alloy which has a similar thermal expansion coefficient to that of alumina ceramics.

Electrically conductive, circular-section stationary and movable contact rods 31 and 32 project through the apertures 24 in the upper and lower disks 22 and 23 respectively to enter the envelope 20 in such a manner as to extend coaxially within the cylinder 21 in an aligned configuration. The rods 31 and 32 are made of copper or a copper alloy. Stationary and movable disk-shaped electrodes 33 and 34 are secured coaxially to the stationary and movable contact rods 31 and 32 respectively at the inner ends thereof. The stationary and movable electrodes 33 and 34 have circular recesses 35 and 36 respectively on outer surfaces thereof. The inner ends of the stationary and movable contact rods 31 and 32 are fitted into the recesses 35 and 36 respectively and brazed to the stationary and movable electrodes 33 and 34 respectively. The movable electrode 34 is formed with a coaxial annular groove 37 on its upper surface. A ring-shaped contact 38 is fitted into the groove 37 and is brazed to the movable electrode 34. The ring-shaped contact 38 easily diffuses an electrical arc applied to each of electrodes 33 and 34 when an electrical current is interrupted. The stationary contact rod 31 is secured to the upper disk 22, while the movable contact rod 32 is suitably mounted to allow for vertical movement, as described hereinafter. When the movable contact rod 32 moves upward or toward the stationary contact rod 31, the contact 38 engages the stationary electrode 33 as shown in FIG. 1, thereby closing the interrupter. When the movable contact rod 32 moves downward or away from the stationary contact rod 31, the contact 38 disengages from the stationary electrode 33, thereby opening the interrupter. Suitable actuating means (not shown) is coupled to the movable contact rod 32 to drive the same upward or downward.

A flexible metallic bellows 39, made of austenitic stainless steel, coaxially surrounds the movable contact rod 32 inside the envelope 20 to provide a seal about the rod 32 to allow vertical movement thereof without impairing the vacuum inside the envelope 20. The bellows 39 is brazed circumferentially at upper end thereof to the lower surface of an annular flange 40 formed on the rod 32 near the upper end thereof, and at the lower end thereof to the inner metalized layer 28 on the lower disk 23. The stationary contact rod 31 is provided with a peripheral annular groove 41 just below the upper disk 22 into which a ring 42 is fitted and brazed to the rod 31. An annular supporting member 43 made of copper or iron is provided between the ring 42 and the inner metalized layer 28 on the upper disk 22. Member 43 is brazed to the ring 42 and the layer 28 to provide a seal about the rod 31. Thus the stationary contact rod 31 is secured to the upper disk 22.

A pair of cylindrical upper and lower auxiliary shields 44 and 45 are coaxially secured to the upper and lower ends of the metallic cylinder 21 respectively. At the upper end of the upper auxiliary shield 44 is an integrally formed flange 46, having a periphery brazed to the cylinder 21. At the lower end of the lower auxiliary shield 45 is a similar flange 47, having a periphery also brazed to the cylinder 21. The auxiliary shields 44 and 45 are made of austenitic stainless steel, copper or iron.

The centers of cup-shaped main shields 48 and 49 are coaxially secured to ends of the stationary and movable contact rods 31 and 32 within the vacuum chamber. The shields 48 and 49 are made of a similar metal to that forming the shields 44 and 45. The bases of main shields 48 and 49 are respectively provided with central apertures 50 and 51 through which the rods 31 and 32 pass; shields 48 and 49 have a greater diameter than that of the shields 44 and 45. The upper main shield 48 faces upward in such a manner as to cover the lower opening of the upper auxiliary shield 44 and partly overlap the lower end of the shield 44 axially. The stationary contact rod 31 is provided, about its periphery near its lower end with an annular groove 52 into which a ring 53 is fitted and brazed to the rod 31. The upper main shield 48 is brazed along the periphery of its central aperture 50 to the upper surface of the ring 53. The lower main shield 49 faces downward in such a manner as to cover the upper opening of the lower auxiliary shield 45 and terminate at its lower end near the same relative axial position therewith as that of the upper end of the shield 45 when the movable rod 32 is in the closed position as shown in FIG. 1. The lower main shield 49 is brazed along the periphery of the central aperture 51 of shield 49 and to the upper surface of the flange 40 on the rod 32. The lower shields 45 and 49 substantially enclose the bellows 39 to protect the same from the deposition of metallic vapors produced by arcing across the electrodes 33 and 34 or the contact 38. The upper shields 44 and 48, and the lower shields 45 and 49 substantially isolate the upper and lower disks 22 and 23 respectively from the electrodes 33, 34 and the contact 38 to protect the inner surfaces of the disks 22 and 23 respectively from the deposition of metallic vapors.

Figure 2:
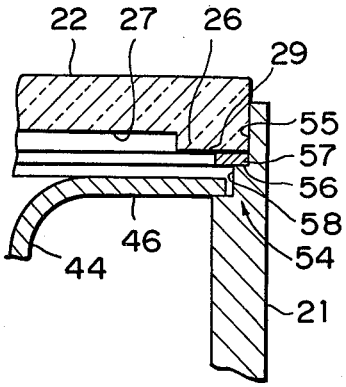
FIG. 2 is an enlarged view of a joint between a metallic cylinder, an upper insulating disk and an upper auxiliary shield, in FIG. 1.

As is best illustrated in FIG. 2 (showing the unbrazed condition), the upper end of the cylinder 21 has an annular double-step 54 on its inner surface. The inside diameter of the cylinder 21 discontinuously increases with the upward direction at the double-step 54. The upper disk 22 is fitted into the largest diameter part 55 of the double-step 54 and is brazed at the metalized layer 29 to the larger diameter shoulder 56 of the double-step 54 with a ring-shaped, rectangular section piece of brazing metal 57 interposed therebetween. The flange 46 of the upper auxiliary shield 44 is fitted into the intermediately sized diameter part 58 of the double-step 54 and is brazed to the metallic cylinder 21 in such a manner as to be parallel to and spaced away from the upper disk 22.

Figure 3:
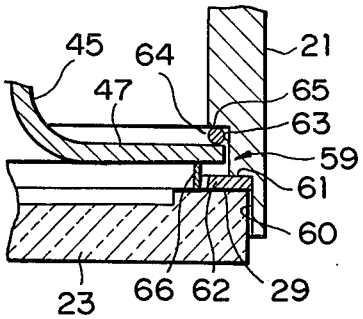
FIG. 3 is an enlarged view of a joint between the metallic cylinder, a lower insulating disk and a lower auxiliary shield, in FIG. 1.

As is best illustrated in FIG. 3 (showing the unbrazed condition), the lower end of the cylinder 21 has an annular double-step 59 on its inner surface. The inside diameter of the cylinder 21 discontinuously increases with the downward direction at the double-step 59. The lower disk 23 is fitted into the largest diameter part 60 of the double-step 59 and is brazed at the metalized layer 29 to the larger diameter shoulder 61 of the double-step 59 with a ring-shaped, rectangular section piece of brazing metal 62 interposed therebetween. The flange 47 of the lower auxiliary shield 45 is fitted into the intermediately sized diameter part 63 of the double-step 59 and is brazed to the metallic cylinder 21 with a ring-shaped wire of brazing metal 64 interposed between the upper surface of the flange 47 and the lesser diameter shoulder 65 of the double-step 59. A ring-shaped thin spacer 66 made of austenitic stainless steel, copper, or iron is provided between the lower surface of the flange 47 and the metalized layer 29 on the lower disk 23 inside the piece of brazing metal 62 to locate the lower auxiliary shield 45 so that the flange 47 will be parallel to but spaced away from the lower disk 23 so as not to touch the same when the interrupter is temporarily assembled as described hereinafter.

Figure 4:
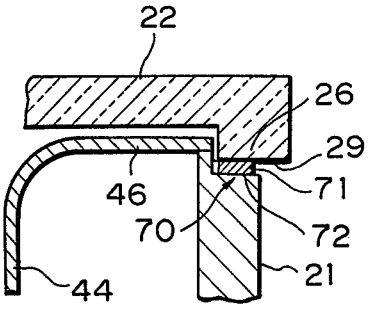
FIGS. 4 to 10 are sectional views of the joints between a metallic cylinder, an insulating disk and an auxiliary shield, according to alternative embodiments of the present invention.

As illustrated in FIG. 4 (showing the un-brazed condition), the upper end of the metallic cylinder 21 may be provided with an annular step 70 on its outer surface instead of the double-step 54. In this case, the outer projection 26 of the upper disk 22 is fitted and then brazed to the step 70 with a ring-shaped, rectangular section piece of brazing metal 71 interposed between the metalized layer 29 on the projection 26 and the shoulder 72 of the step 70, while the flange 46 of the shield 44 is placed on the top end of the cylinder 21. The lower end of the metallic cylinder 21 may be designed in a similar manner to the upper end thereof.

Figure 5:
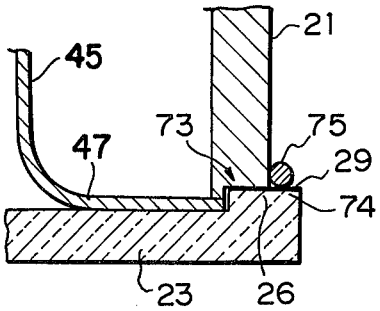

As illustrated in FIG. 5 (showing the un-brazed condition), the metallic cylinder 21 may be provided with an annular step 73 on the outer surface of its lower end instead of the double-step 59, which may be of a lesser outside diameter than that of the lower disk 23 so as to form an annular shoulder 74 outside the cylinder 21. In this case, the outer projection 26 of the disk 23 is fitted and then brazed to the step 73 with a ring-shaped, circular piece of brazing metal 75 placed on the metalized layer 29 of the projection 26 or the shoulder 74 and abutted against the metallic cylinder 21 at the inner corner, while the flange 47 of the shield 45 is placed similarly to that shown in FIG. 4. The lower end of the metallic cylinder 21 may be designed in a similar manner to the upper end thereof.

Figure 6:
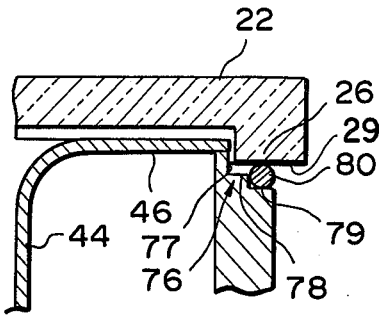

As illustrated in FIG. 6 (showing the un-brazed condition), the upper end of the metallic cylinder 21 may be provided with an annular double-step 76 on its outer surface in such a manner that the outside diameter of the cylinder at the double-step 76 discontinuously decreases with the upward direction, and that the least diameter part 77 of the double-step 76 has a slightly smaller outside diameter than the inside diameter of the projection 26 of the upper disk 22 and has a slightly lower height than that of the projection 26. In this case, the outer projection 26 of the disk 22 is fitted and then brazed to the smaller and larger diameter shoulders 78 and 79 of the double-step 76 with a ring-shaped, circular section piece of brazing metal 80 interposed between the metalized layer 29 on the projection 26 and the larger diameter shoulder 79 of the double-step 76, while the flange 46 of the shield 44 is placed similarly to that shown in FIG. 4. The lower end of the metallic cylinder 21 may be designed in a similar manner to the upper end thereof.

Figure 7:
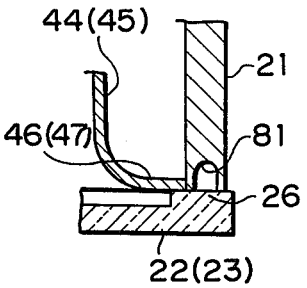
Figure 8:
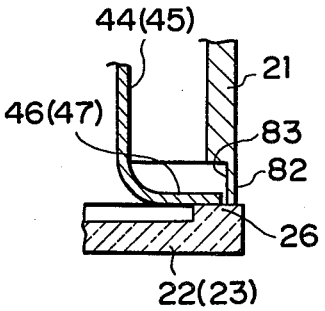
Figure 9:
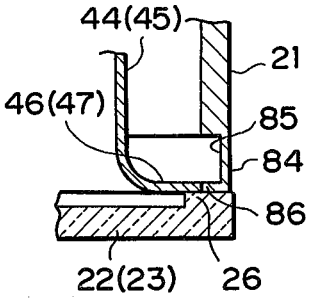
Figure 10:
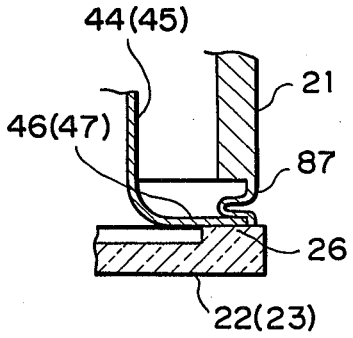

The metallic cylinder 21 may be made of austenitic stainless steel which is a non-magnetic material and has a relatively high mechanical strength. In this case, the metallic cylinder 21 should be provided with a thermal stress relieving or absorbing structure, which is composed of an annular, semicircular section groove 81 formed on each of the end surfaces of the cylinder 21 in contact with the projections 26 of the disk 22 or 23, while the flanges 46 or 47 of the shields 44 or 45 are placed on the projections 26, as shown in FIG. 7. The structure may be constructed of a thin cylindrical segment 82 formed on each of the ends of the cylinder 21 by annular step-shaped grooves 83 on the inner end surfaces of the disk 22 or 23, as shown in FIG. 8. The end of each thin segment 82 is in contact with the projection 26 of the disk 22 or 23. As shown in FIG. 9, the structure may be constructed of a thin annular segment 84 formed on each of the ends of the cylinder 21 by an annular, rectangular groove 85 on the inner surface of the cylinder 21. The groove 85 is positioned away from the end of the cylinder 21 so that a thick cylindrical segment 86 is provided between the thin segment 84 and the projection 26 of the disk 22 or 23 and the end surface of the thick segment 86 or the cylinder 21 is in contact with the projection. As shown in FIG. 10, the structure may be constructed of thin annular, undulating segment 87 formed at each of the ends of the cylinder 21. The thin segment 87 is bent inward to form a U-shaped section thereof and is in contact at the end surface thereof with the projection 26 of the disk 22 or 23.

To manufacture the vacuum circuit interrupter designed as above, the vacuum circuit interrupter is temporarily assembled with brazing metal interposed between the components and then the temporarily assembled vacuum circuit interrupter is brazed in a vacuum furnace.

In order to temporarily assemble the vacuum circuit interrupter, first the insulating disk 23 is supported horizontally so that the metalized layers 28 and 29 thereon face upward and secondly the bellows 39 is placed coaxially on the disk 23 with brazing metal interposed between the inner metalized layer 28 and the lower end of the bellows 39. Thirdly the auxiliary shield 45 is placed coaxially on the disk 23 while the spacer 66 (see FIG. 3) is interposed between the flange 47 thereof and the outer metalized layer 29. Then the movable contact rod 32 is inserted into the bellows 39 from above until the flange 40 thereof abuts on the upper end of the bellows 39 with brazing metal interposed between the flange 40 and the upper end of the bellows 39.

At the upper end of the movable contact rod 32, the shield 49 is first engaged with the flange 40 with brazing metal interposed therebetween, and the movable electrode 34 with the contact 38 fitted into the groove 37 with brazing metal interposed therebetween is fitted onto the upper end of the movable contact rod 32 with brazing metal placed at the bottom of the recess 36.

After the movable portions composed of the movable electrode 34 and the other parts are temporarily assembled on the disk 23 as mentioned above, the metallic cylinder 21 is fitted on the periphery of the disk 23 and the periphery of the flange 47 of the shield 45 at the double-step 59. As shown in FIG. 3, the brazing metal pieces 62 and 64 are first interposed between the cylinder. 21 and the disk 23 at the metalized layer 29, and between the cylinder 21 and the flange 47 of the shield 45 respectively.

The stationary electrode 33 is fitted by the recess 35 to the end of the stationary contact rod 31 with brazing metal interposed therebetween, while the shield 48 is engaged with the ring 53 mounted on the rod 31 with brazing metal interposed therebetween. After the rod 31 with the electrode 33 and the shield 48 is inserted into the cylinder 21 so as to be carried on the movable electrode 34, the flange 46 of the upper auxiliary shield 44 is fitted to the cylinder 21 at the double-step 45 (see FIG. 2) thereof. Then the supporting member 43 is fitted to the stationary contact rod 31 and is engaged with the ring 42 with brazing metal interposed therebetween. The upper disk 22 is placed on the supporting member 43 with brazing metal interposed between the inner metalized layer 28 thereon and the supporting member 43, and lastly the disk 22 is fitted into the cylinder 21 at the double-step 54 with the piece of brazing metal 57 (see FIG. 2) interposed between the outer metalized layer 29 and the shoulder 56 of the double-step 54 of the cylinder 21.

The vacuum circuit interrupter assembled temporarily as mentioned above is placed within a vacuum furnace and heated while the furnace is evacuated to a pressure under $10^{-5}$ Torr. Since the heating degasses the components and also prevents oxidized films from forming on the brazed surfaces, the heating temperature is preferably higher if it does not cause the braze to melt and the vacuum pressure is perferably under $10^{-5}$ Torr. Then the temperature in the vacuum furnace is raised to a value between 900° C. and 1050° C. in order to activate the surface of the austenitic stainless steel, and the components are hermetically joined by the brazing metals while the vacuum furnace is evacuated so as to make the pressure therein under $10^{-5}$ Torr. The inside of the vacuum furnace is gradually cooled from the brazing temperature to a predetermined temperature by furnace cooling for example and then cooled gradually again to room temperature after being maintained at the predetermined temperature for a predetermined time, or is gradually cooled continuously from the brazing temperature to room temperature before the circuit interrupter is taken out from the vacuum furnace.

In the above mentioned manufacturing method, the upper limit of the heating temperature can be under 900° C. by first plating the brazing surfaces of the bellows 39 and the other parts made of austenitic stainless steel with nickel.

The joints between the disks 22 and 23, made of an inorganic insulator, such as alumina ceramic or the like, and the metallic cylinder 21, made of copper or iron, can be made to have an adequate airtight property and mechanical strength although the thermal expansion coefficients thereof are extremely different from each other. As shown by the solid curves in FIG. 11, the tensile strengths of copper and iron increase with decreasing temperature, whereas as shown by the broken curves the elongation rates thereof approximately decrease with decreasing temperature. Therefore, when the copper or iron cylinder 21 is brazed, at a high temperature of 900° C. to 1050° C., to the disks 22 and 23, made of an inorganic insulator such as alumina ceramic or the like, the cylinder 21 is plastically deformed, according to thermal stresses induced during the cooling after brazing, in the gradual cooling process since the tensile strength thereof is extremely small relative to the mechanical strength of the disks 22 and 23. Thus the airtight property of the joints thereof is retained and the residual thermal stresses are extremely small when the joints are cooled to room temperature.

Figure 11:
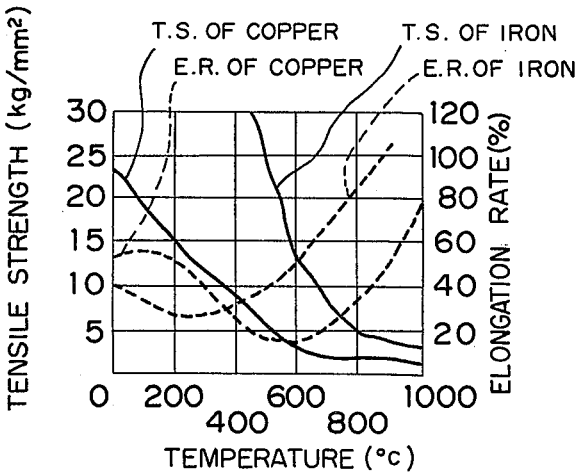
FIG. 11 is a graph of tensile strength and elongation rate against temperature for copper and iron, wherein the solid curves denote the tensile strengths and the broken curves denote the elongation rates.

Iron can be joined hermetically to an inorganic insulator to provide a structure with a high mechanical strength in a similar manner to copper although the tensile strength thereof at each temperature is greater than that of copper as is shown by the solid curves in FIG. 11, and the creep thereof against time under constant loading is less than that of copper, since the thermal expansion coefficient thereof is less than that of copper.

The joint between the lower disk 23 of an inorganic insulator, such as alumina ceramic or the like, and the bellows 39 of austenitic stainless steel can be made to have an adequate airtight property and mechanical strength, since the bellows 39 is approximately 0.1 to 0.2 mm in thickness and the thermal stress caused during cooling after brazing is extremely small relative to the mechanical strength of the disk 23 and consequently the bellows 39 itself deforms plastically in the gradual cooling process.

Figure 12:
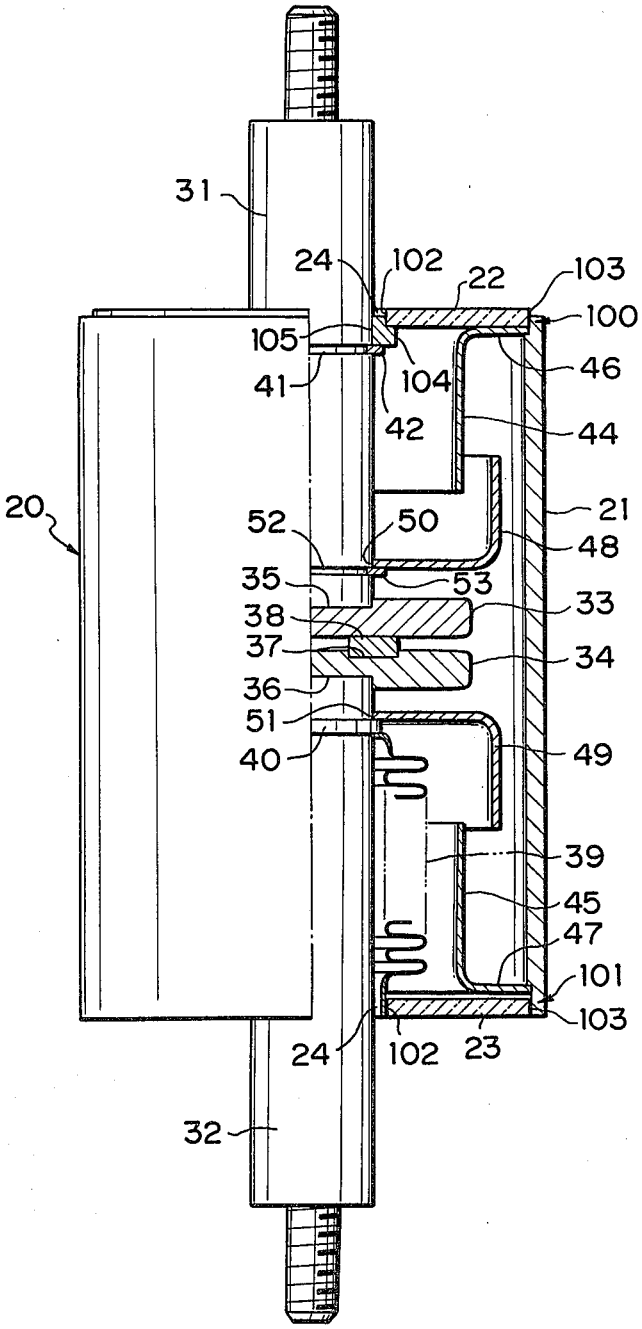
FIG. 12 is a longitudinal partly sectional view of a vacuum circuit interrupter according to a second embodiment of the present invention.

In FIG. 12 is illustrated a vacuum circuit interrupter of a second embodiment of the present invention, wherein similar or corresponding elements are designated by the same numerals as those in FIG. 1. This interrupter is similar to that in FIG. 1 except for the following points.

The metallic cylinder 21 has steps 100 and 101 on each of its inner end surfaces. Each of the upper and lower insulating disks 22 and 23 has metalized layers 102 and 103 on the inner and outer circumferential surfaces thereof respectively. The inner surface of each disk is flat. The outer end of the upper disk 22 is fitted and brazed, at the metalized layer 103, to the upper step 100 of the cylinder 21, while the flange 46 of the upper auxiliary shield 44 is fitted between the shoulder of the step 100 and the disk 22, so as to provide a compression seal about the upper disk 22. The outer end of the lower disk 23 is fitted and brazed, at the metalized layer 103, to the lower step 101 of the cylinder 21 so as to provide a similar seal about the upper disk 22. The flange 47 of the lower auxiliary shield 45 is engaged, by crimping, with the lower step 101 above the lower disk 23 while abutting with the shoulder of the step 101, in order to prevent the shield from being pulled away from the cylinder 21 when the interrupter is temporarily assembled. The flange 47 is so positioned as to be parallel to but spaced from the lower disk 23. A ring-like supporting member 104 of an L-shaped section has a coaxial aperture 105 accommodating snugly the stationary contact rod 31. The supporting member 104 is seated on and brazed to the upper surface of the ring 42 and the outer surface of the contact rod 31, and is seated on and brazed to the inner end of the upper disk 22 at the inner metalized layer 102, so as to provide a seal about the rod 31. The cylindrical lower end of the bellows 39 is circumferentially brazed to the lower disk 23 at the inner metalized layer 102 thereon so as to provide a seal about the movable contact rod 32 and allow for vertical movement thereof.

Figure 13:
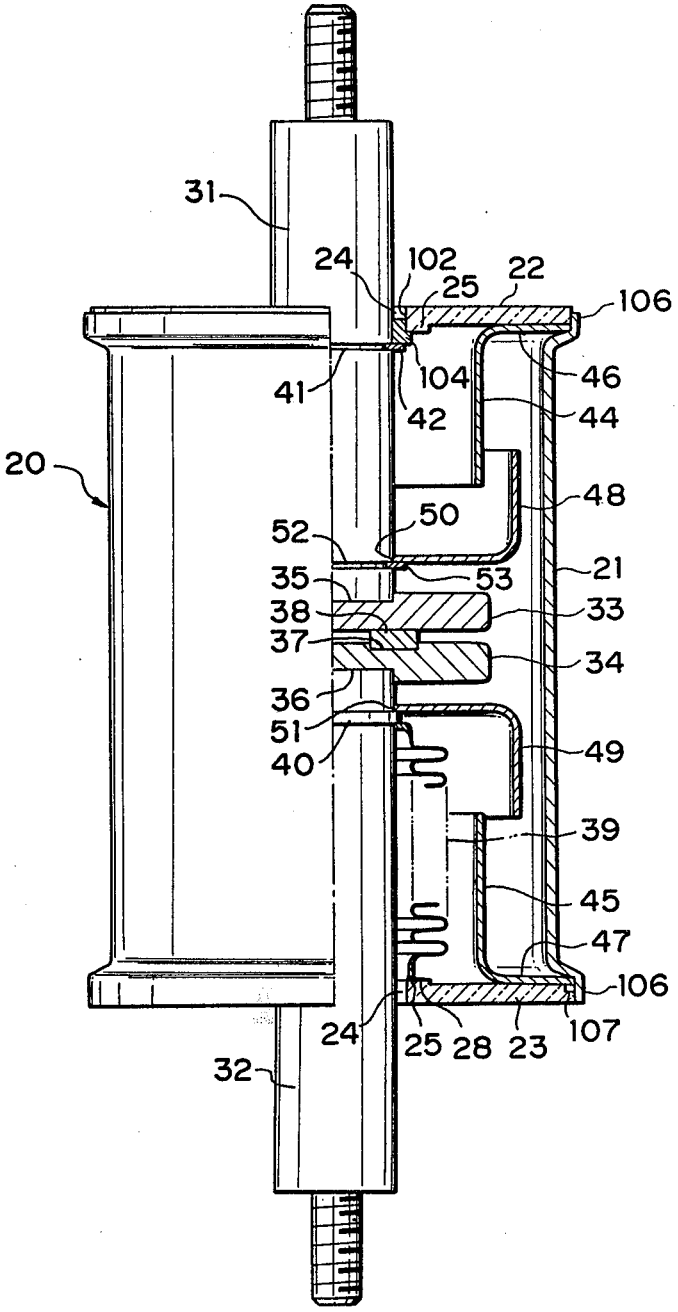
FIG. 13 is a longitudinal partly sectional view of a vacuum circuit interrupter according to a third embodiment of the present invention.

In FIG. 13 is illustrated a vacuum circuit interrupter of a third embodiment of the present invention, wherein similar or corresponding elements are designated by the same numerals as those in FIG. 1 or FIG. 12. This interrupter is similar to that of FIG. 1 or FIG. 12 except for the following points.

The metallic cylinder 21 is provided at its ends with a larger diameter segment or annular lip 106, formed integrally by widening the end of the cylinder 21. The lower insulating disk 23 and the flange 46 of the upper shield 44 are fitted into the annular lip 106 at the upper end of the cylinder 21. The lower insulating disk 23 and the flange 47 of the lower shield 45 are fitted into the annular lip 106 at the lower end of the cylinder 21. Around the upper edge of lower insulating disk 23 an annular groove 107 is cut just beneath the flange 47 of the lower shield 45. The groove 107 accommodates the braze, to provide a compression-seal about the disk 23.

Figure 14:
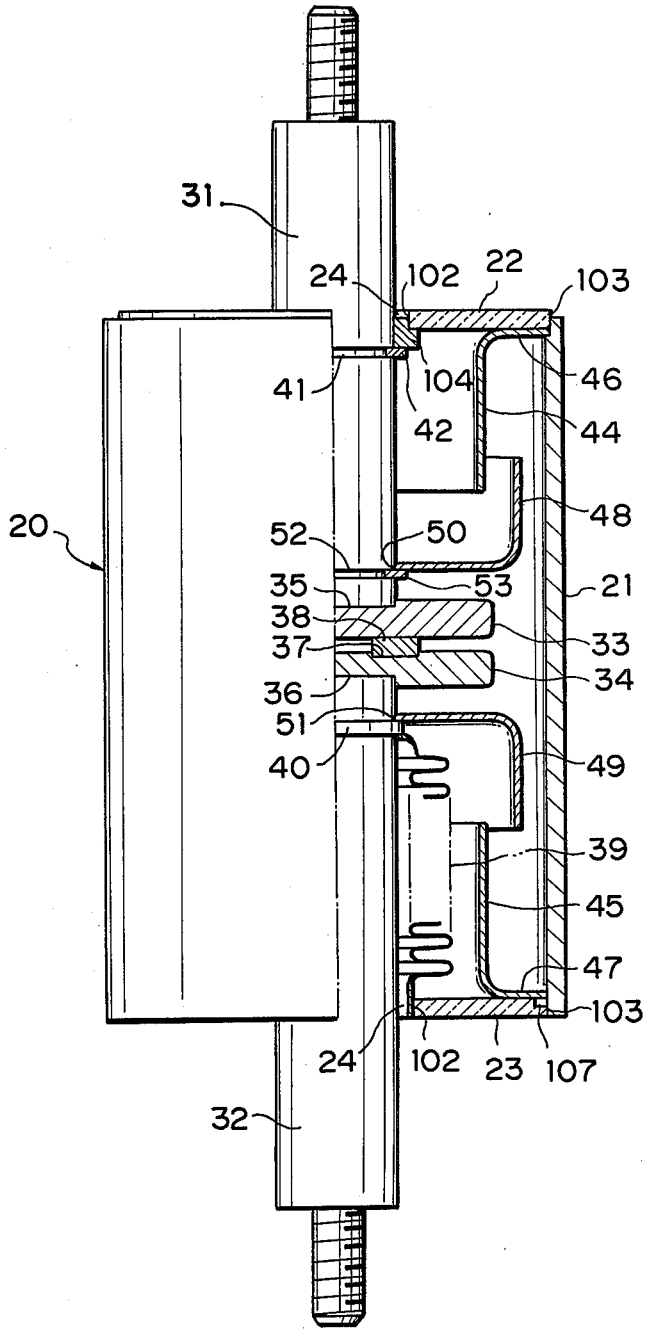
FIG. 14 is a longitudinal partly sectional view of a vacuum circuit interrupter according to a fourth embodiment of the present invention.

In FIG. 14 is illustrated a vacuum circuit interrupter of a fourth embodiment of the present invention, wherein similar or corresponding elements are designated by the same numerals as those in FIG. 12 or 13. This interrupter is similar to that of FIG. 12 or 13 except for the following points. The lower end of the cylinder 21 has a constant inside diameter and the outer ends of the lower disk 23 and the flange 47 of the lower shield 45 fit within the cylinder.

It should be understood that further modifications and variations may be made in the present invention without departing from the spirit and scope of the present invention as set forth in the appended claims.

What is claimed is:

1. A vacuum circuit interrupter comprising:

(a) a metal cylinder;

(b) first and second electrically insulating disks closing opposite ends of the metal cylinder to form therewith an evacuated envelope, each of the first and second disks having a coaxial central aperture;

(c) a stationary conductive rod coaxially entering the envelope through the central aperture of the first disk, the stationary rod being fixed to the first disk in such a manner as to provide a seal therewith;

(d) a movable conductive rod coaxial with and movably entering the envelope through the central aperture of the second disk without impairing the vacuum inside the envelope;

(e) stationary and movable electrodes respectively connected to the stationary and movable rods in such a manner as to engage each other when the movable rod moves toward the stationary rod and disengage from each other when the movable rod moves away from the stationary rod; and (f) a bellows surrounding the movable rod inside the envelope, first and second ends of the bellows being respectively fixed to the movable rod and to the second disk in such a manner as to provide a seal about the movable rod to allow for movement of the movable rod without impairing the vacuum inside the envelope;

the improvement comprising:

(g) the metal cylinder having a different coefficient of thermal expansion from those of the first and second insulating disks;

(h) brazing means for directly fixing the metal cylinder to a metallized layer on each outer peripheral portion of the first and second insulating disks in a hermetic seal; and (i) the metal forming the metal cylinder being made of a material that is relatively-easily deformed plastically by thermal stress generated during a cooling process after the metal cylinder was brazed to the first and second insulating disks;

(j) first and second cylindrical auxiliary shields each having a flange; and (k) first and second cup-shaped main shields, the first main shield being fixed to the stationary rod, the flange of the first auxiliary shield being fixed to the metal cylinder so that the first auxiliary shield and cylinder are fixed in such a manner that the first main and first auxiliary shields substantially isolate the first insulating disk from the movable and stationary electrodes, the second main shield being fixed to the movable rod, the flange of the second auxiliary shield being fixed to the metal cylinder so that the second auxiliary shield and cylinder are fixed in such a manner that the second main and auxiliary shields substantially isolate the bellows and the second insulating disk from the movable and stationary electrodes.

2. The vacuum circuit interrupter of claim 1 wherein the bellows is dimensioned and made of a material having thermal stress caused during cooling after brazing that is extremely small relative to the mechanical strength of the second disk so that the bellows deforms itself plastically during gradual cooling thereof after brazing.

3. The vacuum circuit interrupter of claim 1 wherein the bellows is dimensioned and made of austenitic stainless steel having thermal stress caused during cooling after brazing that is extremely small relative to the mechanical strength of the second disk so that the bellows deforms itself plastically during gradual cooling thereof after brazing.

4. A vacuum circuit interrupter comprising:

(a) a metal cylinder;

(b) first and second electrically insulating disks abutting against and closing opposite ends of the metal cylinder to form therewith an evacuated vacuum envelope, each of the first and second disks having a coaxial central aperture, the first and second disks having a coefficient of thermal expansion different from that of the cylinder such that if there were a direct fixed connection between the disks and cylinder there would be a tendency for the vacuum in the envelope to be destroyed as the envelope temperature changes;

(c) a stationary conductive rod coaxially entering the envelope through the central aperture of the first disk, the stationary rod being fixed to the first disk in such a manner as to provide a seal therewith;

(d) a movable conductive rod coaxial with and movably entering the envelope through the central aperture of the second disk without impairing the vacuum inside the envelope;

(e) stationary and movable electrodes respectively connected to the stationary and movable rods in such a manner as to engage each other when the movable rod moves toward the stationary rod and disengage from each other when the movable rod moves away from the stationary rod;

(f) a bellows surrounding the movable rod inside the envelope, first and second ends of the bellows being respectively fixed to the movable rod and to the second disk in such a manner as to provide a seal about the movable rod to allow for movement of the movable rod without impairing the vacuum inside the envelope;

(g) means for overcoming the tendency for the vacuum in the envelope to be destroyed as the envelope temperature changes even though the envelope is formed of a relatively inexpensive alloy having a coefficient of thermal expansion which does not closely match that of the disks;

said means for overcoming including:

(i) a metallized layer on a face of each insulating layer abutting against the cylinder, the metallized layer having a coefficient of thermal expansion similar to that of the insulating layers;

(ii) brazed metal directly connecting the metallized layers to opposite ends of the cylinder to form the evacuated envelope;

the metal forming the metal cylinder being made of a material that is relatively easy to deform by thermal stresses so that portions of the cylinder abutting against the insulating disks are deformed plastically, the plastic deformation occurring in response to thermal stresses occurring in the cylinder as it is cooled after having been heated by the metallized layers on the first and second insulating disks being brazed to the brazed metal;

(h) first and second cylindrical auxiliary shields each having a flange; and (i) first and second cup-shaped main shields, the first main shield being fixed to the stationary rod, the flange of the first auxiliary shield being fixed to the metal cylinder so that the first auxiliary shield and cylinder are fixed in such a manner that the first main and first auxiliary shields substantially isolate the first insulating disk from the movable and stationary electrodes, the second main shield being fixed to the movable rod, the flange of the second auxiliary shield being fixed to the metal cylinder so that the second auxiliary shield and cylinder are fixed in such a manner that the second main and auxiliary shields substantially isolate the bellows and the second insulating disk from the movable and stationary electrodes.

5. A vacuum circuit interrupter comprising:

(a) a metal cylinder;

(b) first and second electrically insulating disks closing opposite ends of the metal cylinder to form therewith an evacuated envelope, each of the first and second disks having a coaxial central aperture;

(c) a stationary conductive rod coaxially entering the envelope through the central aperture of the first disk, the stationary rod being fixed to the first disk in such a manner as to provide a seal therewith;

(d) a movable conductive rod coaxial with and movably entering the envelope through the central aperture of the second disk without impairing the vacuum inside the envelope;

(e) stationary and movable electrodes respectively connected to the stationary and movable rods in such a manner as to engage each other when the movable rod moves toward the stationary rod and disengage from each other when the movable rod moves away from the stationary rod;

(f) a bellows surrounding the movable rod inside the envelope, first and second ends of the bellows being respectively fixed to the movable rod and to the second disk in such a manner as to provide a seal about the movable rod to allow for movement of the movable rod without impairing the vacuum inside the envelope;

the improvement comprising:

(g) the metal cylinder having a different coefficient of thermal expansion from those of the first and second insulating disks;

(h) brazing means for directly fixing the metal cylinder to a metallized layer on each outer peripheral portion of the first and second insulating disks in a hermetic seal;

(i) the metal forming the metal cylinder being made of a material that is relatively-easily deformed plastically by thermal stress generated during a cooling process after the metal cylinder was brazed to the first and second insulating disks;

(j) first and second cylindrical auxiliary shields each having a flange; and (k) first and second cup-shaped main shields, the first main shield being fixed to the stationary rod, the flange of the first auxiliary shield being fixed to the metal cylinder so that the first auxiliary shield and cylinder are fixed in such a manner that the first main and first auxiliary shields substantially isolate the first insulating disk from the movable and stationary electrodes, the second main shield being fixed to the movable rod, the flange of the second auxiliary shield being fixed to the metal cylinder so that the second auxiliary shield and cylinder are fixed in such a manner that the second main and auxiliary shields substantially isolate the bellows and the second insulating disk from the movable and stationary electrodes, the stationary and movable electrodes including disks coaxially respectively connected to ends of the stationary and movable rods, the movable electrode having a coaxial annular contact on an end thereof adjacent the stationary electrode, the contact engaging and disengaging the stationary electrode in response to movement of the movable rod.

6. A vacuum circuit interrupter comprising:

(a) a metal cylinder;

(b) first and second electrically insulating disks abutting against and closing opposite ends of the metal cylinder to form therewith an evacuated vacuum envelope, each of the first and second disks having a coaxial central aperture, the first and second disks having a coefficient of thermal expansion different from that of the cylinder such that if there were a direct fixed connection between the disks and cylinder there would be a tendency for the vacuum in the envelope to be destroyed as the envelope temperature changes;

(c) a stationary conductive rod coaxially entering the envelope through the central aperture of the first disk, the stationary rod being fixed to the first disk in such a manner as to provide a seal therewith;

(d) a movable conductive rod coaxial with and movably entering the envelope through the central aperture of the second disk without impairing the vacuum inside the envelope;

(e) stationary and movable electrodes respectively connected to the stationary and movable rods in such a manner as to engage each other when the movable rod moves toward the stationary rod and disengage from each other when the movable rod moves away from the stationary rod;

(f) a bellows surrounding the movable rod inside the envelope, first and second ends of the bellows being respectively fixed to the movable rod and to the second disk in such a manner as to provide a seal about the movable rod to allow for movement of the movable rod without impairing the vacuum inside the envelope;

(g) means for overcoming the tendency for the vacuum in the envelope to be destroyed as the envelope temperature changes even though the envelope is formed of a relatively inexpensive alloy having a coefficient of thermal expansion which does not closely match that of the disks;

said means for overcoming including:

(i) a metallized layer on a face of each insulating layer abutting against the cylinder, the metallized layer having a coefficient of thermal expansion similar to that of the insulating layers;

(ii) brazed metal directly connecting the metallized layers to opposite ends of the cylinder to form the evacuated envelope;

the metal forming the metal cylinder being made of a material that is relatively easy to deform by thermal stresses so that portions of the cylinder abutting against the insulating disks are deformed plastically, the plastic deformation occurring in response to thermal stresses occurring in the cylinder as it is cooled after having been heated by the metallized layers on the first and second insulating disks being brazed to the brazed metal;

(h) first and second cylindrical auxiliary shields each having a flange; and (i) first and second cup-shaped main shields, the first main shield being fixed to the stationary rod, the flange of the first auxiliary shield being fixed to the metal cylinder so that the first auxiliary shield and cylinder are fixed in such a manner that the first main and first auxiliary shields substantially isolate the first insulating disk from the movable and stationary electrodes, the second main shield being fixed to the movable rod, the flange of the second auxiliary shield being fixed to the metal cylinder so that the second auxiliary shield and cylinder are fixed in such a manner that the second main and auxiliary shields substantially isolate the bellows and the second insulating disk from the movable and stationary electrodes, the stationary and movable electrodes including disks coaxially respectively connected to ends of the stationary and movable rods, the movable electrode having a coaxial annular contact on an end thereof adjacent the stationary electrode, the contact engaging and disengaging the stationary electrode in response to movement of the movable rod.

7. A vacuum circuit interrupter comprising:

(a) a metal cylinder;

(b) first and second electrically insulating disks closing opposite ends of the metal cylinder to form therewith an evacuated envelope, each of the first and second disks having a coaxial central aperture;

(c) a stationary conductive rod coaxially entering the envelope through the central aperture of the first disk, the stationary rod being fixed to the first disk in such a manner as to provide a seal therewith;

(d) a movable conductive rod coaxial with and movably entering the envelope through the central aperture of the second disk without impairing the vacuum inside the envelope;

(e) stationary and movable electrodes respectively connected to the stationary and movable rods in such a manner as to engage each other when the movable rod moves toward the stationary rod and disengage from each other when the movable rod moves away from the stationary rod;

(f) a bellows surrounding the movable rod inside the envelope, first and second ends of the bellows being respectively fixed to the movable rod and to the second disk in such a manner as to provide a seal about the movable rod to allow for movement of the movable rod without impairing the vacuum inside the envelope;

the improvement comprising:

(g) the metal cylinder having a different coefficient of thermal expansion from those of the first and second insulating disks;

(h) brazing means for directly fixing the metal cylinder to a metallized layer on each outer peripheral portion of the first and second insulating disks in a hermetic seal;

the metal forming the metal cylinder being made of a material that is relatively-easily deformed plastically by thermal stress generated during a cooling process after the metal cylinder was brazed to the first and second insulating disks;

(i) first and second cylindrical auxiliary shields each having a flange; and (j) first and second cup-shaped main shields, the first main shield being fixed to the stationary rod, the flange of the first auxiliary shield being fixed to the metal cylinder so that the first auxiliary shield and cylinder are fixed in such a manner that the first main and first auxiliary shields substantially isolate the first insulating disk from the movable and stationary electrodes, the second main shield being fixed to the movable rod, the flange of the second auxiliary shield being fixed to the metal cylinder so that the second auxiliary shield and cylinder are fixed in such a manner that the second main and auxiliary shields substantially isolate the bellows and the second insulating disk from the movable and stationary electrodes, the metal cylinder being a non-magnetic metal.

8. A vacuum circuit interrupter comprising:

(a) a metal cylinder;

(b) first and second electrically insulating disks abutting against and closing opposite ends of the metal cylinder to form therewith an evacuated vacuum envelope, each of the first and second disks having a coaxial central aperture, the first and second disks having a coefficient of thermal expansion different from that of the cylinder such that if there were a direct fixed connection between the disks and cylinder there would be a tendency for the vacuum in the envelope to be destroyed as the envelope temperature changes;

(c) a stationary conductive rod coaxially entering the envelope through the central aperture of the first disk, the stationary rod being fixed to the first disk in such a manner as to provide a seal therewith;

(d) a movable conductive rod coaxial with and movably entering the envelope through the central aperture of the second disk without impairing the vacuum inside the envelope;

(e) stationary and movable electrodes respectively connected to the stationary and movable rods in such a manner as to engage each other when the movable rod moves toward the stationary rod and disengage from each other when the movable rod moves away from the stationary rod;

(f) a bellows surrounding the movable rod inside the envelope, first and second ends of the bellows being respectively fixed to the movable rod and to the second disk in such a manner as to provide a seal about the movable rod to allow for movement of the movable rod without impairing the vacuum inside the envelope;

(g) means for overcoming the tendency for the vacuum in the envelope to be destroyed as the envelope temperature changes even though the envelope is formed of a relatively inexpensive alloy having a coefficient of thermal expansion which does not closely match that of the disks;

said means for overcoming including:

(i) a metallized layer on a face of each insulating layer abutting against the cylinder, the metallized layer having a coefficient of thermal expansion similar to that of the insulating layers;

(ii) brazed metal directly connecting the metallized layers to opposite ends of the cylinder to form the evacuated envelope;

the metal forming the metal cylinder being made of a material that is relatively easy to deform by thermal stresses so that portions of the cylinder abutting against the insulating disks are deformed plastically, the plastic deformation occurring in response to thermal stresses occurring in the cylinder as it is cooled after having been heated by the metallized layers on the first and second insulating disks being brazed to the brazed metal;

(h) first and second cylindrical auxiliary shields each having a flange; and (i) first and second cup-shaped main shields, the first main shield being fixed to the stationary rod, the flange of the first auxiliary shield being fixed to the metal cylinder so that the first auxiliary shield and cylinder are fixed in such a manner that the first main and first auxiliary shields substantially isolate the first insulating disk from the movable and stationary electrodes, the second main shield being fixed to the movable rod, the flange of the second auxiliary shield being fixed to the metal cylinder so that the second auxiliary shield and cylinder are fixed in such a manner that the second main and auxiliary shields substantially isolate the bellows and the second insulating disk from the movable and stationary electrodes, the metal cylinder being a non-magnetic metal.

9. A vacuum circuit interrupter comprising:

(a) an evacuated envelope consisting essentially of a metal cylinder, first and second electrically insulating disks, a stationary conductive rod, a movable conductive rod, an annular supporting member, and a metal bellows;

(b) the first and second electrically insulating disks closing opposite ends of the metal cylinder, each of the first and second disks having a coaxial central aperture;

(c) the stationary conductive rod coaxially entering the envelope through the central aperture of the first disk, the stationary rod being fixed to the first disk via the annular supporting member in such a manner as to provide a seal therewith;

(d) the movable conductive rod coaxial with and movably entering the envelope through the central aperture of the second disk without impairing the vacuum inside the envelope;

(e) stationary and movable electrodes respectively connected to the stationary and movable rods in such a manner as to engage each other when the movable rod moves toward the stationary rod and disengage from each other when the movable rod moves away from the stationary rod;

(f) the bellows surrounding the movable rod inside the envelope, first and second ends of the bellows being respectively fixed to the movable rod and to the second disk in such a manner as to provide a seal about the movable rod to allow for movement of the movable rod without impairing the vacuum inside the envelope;

the improvement comprising:

(g) the metal cylinder having a different coefficient of thermal expansion from those of the first and second insulating disks;

(h) brazing means for directly fixing the metal cylinder to a metallized layer on each outer peripheral portion of the first and second insulating disks in a hermetic seal;

(i) a metal forming the metal cylinder being made of a plastically deformable metallic material that is deformable by thermal stress generated during a gradual cooling process after brazing, wherein each hermetic fixing and seal between the metal cylinder and the first and second insulating disks is obtained by plastically deforming both brazing portions of the metal cylinder after brazing the metal cylinder to the first and second insulating disks;

(j) brazing means for fixing the second end of the bellows to a metallized layer on an inner peripheral portion of the second insulating disk in a hermetic seal;

(k) the metal bellows being made of a plastically deformable metallic material that is deformable by thermal stress generated during a gradual cooling process after brazing, wherein a hermetic fixing and seal between the metal bellows and the second insulating disk are obtained by plastically deforming a brazing portion of the bellows after brazing the metal bellows to the second insulating disk; and (l) the evacuated envelope being completely produced by a last heating of brazing in vacuum.

10. A vacuum circuit interrupter comprising:

(a) an evacuated envelope consisting essentially of a metal cylinder made of a brazed metal, first and second electrically insulating disks, a stationary conductive rod, a movable conductive rod, an annular supporting member, and a metal bellows;

(b) the first and second electrically insulating disks abutting against and closing opposite ends of the metal cylinder, each of the first and second disks having a coaxial central aperture, the first and second disks having a coefficient of thermal expansion different from that of the cylinder such that if there were a direct fixed connection between the disks and cylinder there would be a tendency for the vacuum in the envelope to be destroyed as the envelope temperature changes;

(c) the stationary conductive rod coaxially entering the envelope through the central aperture of the first disk, the stationary rod being fixed to the first disk via the annular supporting member in such a manner as to provide a seal therewith;

(d) the movable conductive rod coaxial with and movably entering the envelope through the central aperture of the second disk without impairing the vacuum inside the envelope;

(e) stationary and movable electrodes respectively connected to the stationary and movable rods in such a manner as to engage each other when the movable rod moves toward the stationary rod and disengage from each other when the movable rod moves away from the stationary rod;

(f) the metal bellows surrounding the movable rod inside the envelope, first and second ends of the bellows being respectively fixed to the movable rod and to the second disk in such a manner as to provide a seal about the movable rod to allow for movement of the movable rod without impairing the vacuum inside the envelope;

(g) means for overcoming the tendency for the vacuum in the envelope to be destroyed as the envelope temperature changes even though the envelope is formed of a relatively inexpensive alloy having a coefficient of thermal expansion which does not closely match that of the disks;

said means for overcoming including:

(i) a metallized layer on a face of each insulating disk abutting against the cylinder;

(ii) the brazed metal directly connecting the metallized layers to opposite ends of the cylinder;

the brazed metal forming the metal cylinder being made of a material that is relatively easy to deform by thermal stresses generated during a gradual cooling process after brazing, wherein each hermetic fixing and seal between the metal cylinder and the first and second insulating disks is obtained by plastically deforming both brazing portions of the metal cylinder abutting against the insulating disks after brazing the metal cylinder to the insulating disks; and (iii) the evacuated envelope being completely produced by a last heating of brazing in vacuum.

11. The vacuum circuit interrupter of claim 7 or 8 wherein the metal cylinder is made of copper.

12. The vacuum circuit interrupter of claim 7 or 9 wherein the metal cylinder is made of iron.

13. The vacuum circuit interrupter of claim 9 or 10 wherein the stationary and movable electrodes include disks coaxially respectively connected to ends of the stationary and movable rods, the movable electrode having a coaxial annular contact on an end thereof adjacent the stationary electrode, the contact engaging and disengaging the stationary electrode in response to movement of the movable rod.

14. The vacuum circuit interrupter of claim 9 or 10 wherein the metal cylinder is made of a non-magnetic metal.

15. The vacuum circuit interrupter of claim 9 or 10 wherein the metal cylinder is made of copper.

16. The vacuum circuit interrupter of claim 9 or 10 wherein the metal cylinder is made of iron.

* * * * *